US006490973B1

(12) United States Patent
Bösen et al.

(10) Patent No.: US 6,490,973 B1
(45) Date of Patent: Dec. 10, 2002

(54) LOCKING DEVICE IN A PRINTING MACHINE

(75) Inventors: Kurt Bösen, Dannstadt-Schauernheim (DE); Jens Friedrichs, Neckargemünd (DE); Frank Schaum, Neckargemünd (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/428,581

(22) Filed: Oct. 28, 1999

(30) Foreign Application Priority Data

Oct. 28, 1998 (DE) ..... 298 19 184 U

(51) Int. Cl.[7] ..... B41F 5/00
(52) U.S. Cl. ..... 101/216; 101/479
(58) Field of Search ..... 101/216, 365, 101/479, 480, 148; 400/674

(56) References Cited

U.S. PATENT DOCUMENTS 1,174,305 A * 3/1916 Blum ..... 400/674
1,829,390 A * 10/1931 Barr ..... 400/674
2,555,521 A * 6/1951 Veltman et al. ..... 400/674
3,757,689 A * 9/1973 Koch et al. ..... 101/148
4,590,858 A 5/1986 Sedlak et al.
5,644,983 A 7/1997 Herrmann et al.
5,960,714 A * 10/1999 Göttling et al. ..... 101/216
5,992,313 A * 11/1999 Zimmer ..... 101/479
6,230,620 B1 * 5/2001 Christmann et al. ..... 101/216

FOREIGN PATENT DOCUMENTS

DE 634 392 12/1934
DE 32 25 564 A1 1/1984
DE 34 44 561 A1 6/1985
DE 44 42 279 A1 5/1996

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A device for locking a carrier carrying a cylinder in a printing machine, the cylinder being rotatably mounted in the carrier, and a pivoting lever by which the carrier is lockable to a frame, includes a pivot bearing about which the locked pivoting lever is pivotable while the locking action is maintained; and a printing machine including the locking device.

17 Claims, 4 Drawing Sheets

27
28
6,54
32
25
31,54
63
8
50
3
33
29
9
63
6,62
31,62
56
31,55
57
6,55
7,55
33
60
58
4
47
48
49
7,62
24
23
43
36
42
46
41
19
20
44
40
18
45
38
39
22
37
5
17
30
10
59
M
15
14
13
21
12
11
53
16
26
35

LOCKING DEVICE IN A PRINTING MACHINE

BACKGROUND OF THE INVENTION

FIELD OF THE INVENTION

The invention relates to a device for locking a carrier carrying a cylinder in a printing machine, the cylinder being rotatably mounted in the carrier, and a pivoting lever by which the carrier is lockable to a frame.

Locking devices of this general type are used to secure the carrier and, therefore, the cylinder in a specific position in the printing machine.

For example, German Patent 634 392 describes a device for throwing a blanket cylinder on and off a plate cylinder in transfer-printing devices. If a sample or pattern is to be transferred to the blanket cylinder, the pressman places the sample or pattern into an open bearing of an outwardly swingable swinging rod, and moves the blanket cylinder with the swinging rod about a hinge thereof towards the plate cylinder that is mounted in a machine frame. A lever provided with a hook is fixed to the swinging rod. The swinging rod can be locked to the machine frame by a hook that engages behind a lug on the machine frame, and can be unlocked from the machine frame by lifting the hook out of engagement with the lug. The lever is pivotable about a pin in order to connect and release the locking members, but not while the locking action is being maintained.

The aforedescribed locking device is well suited for use in the described transfer-printing device, but cannot be used for other applications in printing machines.

SUMMARY OF THE INVENTION

It is accordingly an object of the invention, therefore, to provide a further locking device useful for several applications in printing machines.

With the foregoing and other objects in view, there is provided, in accordance with one aspect of the invention, a device for locking a carrier carrying a cylinder in a printing machine, the cylinder being rotatably mounted in the carrier, and a pivoting lever by which the carrier is lockable to a frame, comprising a pivot bearing about which the locked pivoting lever is pivotable while the locking action is maintained.

In accordance with another feature of the invention, the pivoting lever and the carrier are couplable to one another by a releasable formlocking connection. In this regard, it is noted that a formlocking connection is one which connects two elements together due to the shape of the elements themselves, as opposed to a forcelocking connection, which locks the elements together by force external to the elements.

In accordance with a further feature of the invention, the pivot bearing is adjustable so as to displace a pivot axis of the pivot bearing during the adjustment.

In accordance with an added feature of the invention, the pivot bearing is an eccentric bearing.

In accordance with an additional feature of the invention, the locking device includes a mechanism selected from the group thereof consisting of a cam mechanism and a lever mechanism, the pivoting lever being pivotable by the mechanism.

In accordance with yet another feature of the invention, the cam mechanism comprises a connecting link guide and a part guidable therein.

In accordance with yet a further feature of the invention, the cam mechanism is constructed for driving the pivoting lever in a pivoting movement about the pivot bearing, the pivoting movement coupling the pivoting lever to the carrier.

In accordance with yet an added feature of the invention, the locking device comprises a damped spring by which a pivoting lever is pivotable in a first pivoting direction for coupling the pivoting lever and the carrier in a formlocking connection, and in a second pivoting direction, by the lever mechanism, counter to the action of the spring, for releasing the formlocking connection.

In accordance with yet an additional feature of the invention, the locking device includes a drive for selectively adjusting the carrier into a first position and into a second position, respectively, along an adjustment path.

In accordance with still another feature of the invention, the drive is a pull mechanism drive.

In accordance with still a further feature of the invention, at least one further cylinder is rotatably mounted in the carrier.

In accordance with still an added feature of the invention, the carrier and the cylinder together are selectively liftable and lowerable, respectively, by the drive, in a linear and approximately vertical direction of motion, into the first position and into the second position.

In accordance with another aspect of the invention, there is provided a printing machine including at least one locking device constructed in accordance with at least one of the foregoing features.

The device for locking a carrier carrying a cylinder in a printing machine, the cylinder being rotatably mounted in the carrier, and a pivoting lever by which the carrier is lockable to a frame, is distinguished by the fact that the locked pivoting lever can be pivoted about a pivot bearing while the locking action is maintained.

The locking of the carrier to the frame is performed via a releasable positive connection of the pivoting lever either to the frame or to the carrier. The term cylinder should also be understood to include a roller.

In an advantageous embodiment further developing the invention, the pivoting lever and the carrier are couplable to one another by a releasable formlocking connection.

The releasable formlocking connection may include a hook-like end of the pivoting lever and a pin fastened to the carrier. At the end of the pivoting lever located opposite to the hook-like end thereof, the pivoting lever is mounted in the pivot bearing. The pivot bearing can, in this case, be disposed on the frame, the pivot lever being rotatably fixed to the frame by the pivot bearing. As an alternative, an engagement element, for example the pin, can also be provided on the pivoting lever, and a recess accommodating the engagement element, for example, the claw, can be provided on the frame or on the carrier.

In a further embodiment, the pivot bearing is adjustable in such a way that, during the adjustment, a pivot axis of the pivot bearing is displaced.

Two-stage locking is possible by a pivot bearing constructed in this manner. For example, in a first stage, the formlock of the releasable formlocking connection can be produced, and, in a second stage, the pivot axis of the pivot bearing can be displaced and, simultaneously, the pivoting lever can be drawn or pulled in the direction of the pivot bearing. As a result of the adjustment of the pivoting lever on the pivot bearing, a frictional fit or a further formlock additionally becomes effective between the parts forming the releasable formlocking connection, for example, a claw of the hook-like end of the pivoting lever and a pin enclosed by the claw, and secures the lock.

In a further embodiment, the pivot bearing is an eccentric bearing.

The eccentric bearing for adjusting the pivoting lever is small and takes up little space.

In a further embodiment, the pivoting lever is pivotable by a cam drive or a lever drive.

The movement of the pivoting lever during the locking action is guidable very precisely by drives of this type.

In a further embodiment, the cam drive comprises a connecting link guide and a part guided therein.

The connecting link guide can be formed with a groove or a slot, and the part guided in the connecting link guide can be constructed as a sliding block or pin or roller.

In a further embodiment, the cam drive is constructed for driving the pivoting lever into a pivoting movement about the pivot bearing, this pivoting movement coupling the pivoting lever to the carrier.

Through the intermediary of the cam mechanism, the releasable formlocking connection can be formed and released selectively either between the pivoting lever and the carrier or between the pivoting lever and the frame, depending upon the existing construction of the device, and can, for example, bring the claw into and out of engagement with the pin. The part guided in the connecting link guide can be fastened to the pivoting lever. Furthermore, other types of mechanisms and actuating drives can be used to effect this pivoting movement of the pivoting lever.

In a further embodiment, the carrier is adjustable by a drive selectively into a first position and into a second position along an adjustment path.

The cylinder mounted in the carrier can be thrown onto another cylinder mounted in the frame or thrown off this other cylinder by a throw-on or throw-off movement. The directions of adjustment of the carrier by the drive along the adjustment path, and the adjustment of the cylinder to throw it onto or off the cylinder mounted in the frame are preferably different adjustment directions.

In a further embodiment, the drive is a pull mechanism drive.

The pull mechanism drive is preferably a paired-form or form-paired pull mechanism drive, for example, a toothed belt drive or transmission or preferably a chain drive or transmission. By using such a drive, the carrier and the cylinder can be disposed in different positions with a high positioning accuracy.

In a further embodiment, at least one further cylinder is rotatably mounted in the carrier.

The first-mentioned cylinder and the further cylinder mounted in the carrier are preferably arranged with the axes thereof parallel to one another, and the outer or jacket surfaces of the cylinders are disposed in circumferential contact with one another, or have a very small spacing from one another. For example, the first-mentioned cylinder can be an applicator cylinder for applying a coating liquid to a printing material, and the further cylinder can be a metering or halftone roller assigned to the applicator cylinder and feeding the coating liquid thereto.

In a further embodiment, the carrier, together with the cylinder, can be raised and lowered selectively by the drive, in a linear and precisely or approximately vertical direction of motion, into the first position and into the second position, respectively.

This construction is very advantageous with respect to the accessibility of the unit made up of the carrier and the cylinder and in relation to the required space, if the locking device is part of a finishing unit which processes or coats the printing material, and, for example, is integrated into a varnishing unit.

The device according to the invention can be used in rotary printing machines which print web-like or sheet-like printing material and which may be constructed as an offset printing machine.

Other features which are considered as characteristic for the invention are set forth in the appended claims.

Although the invention is illustrated and described herein as embodied in a locking device in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
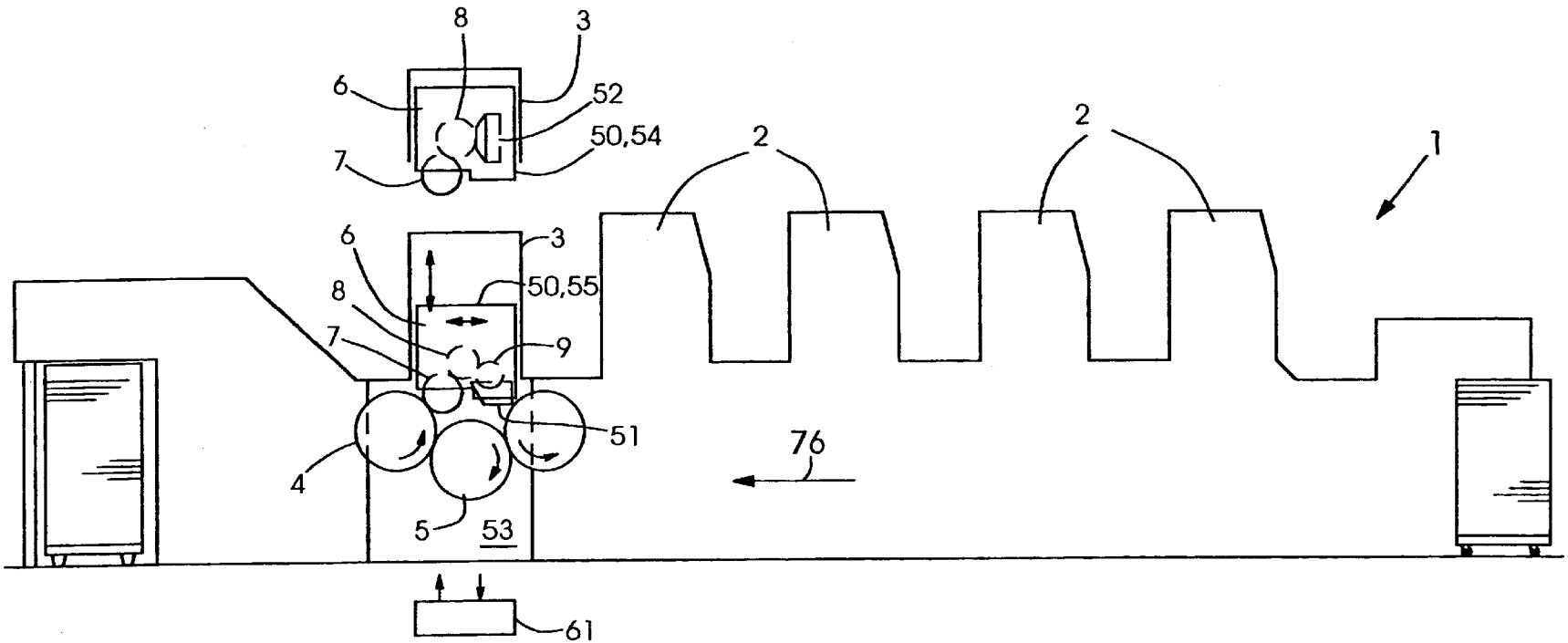
FIG. 1 is a diagrammatic side elevational view of a printing machine with a finishing unit, in which the positioning device according to the invention is integrated.

Referring now to the drawings and, first, particularly to FIG. 1 thereof, there is shown therin a printing machine 1 constructed as an in-line sheet-fed rotary offset printing machine and having a finishing unit 3. As viewed in the sheet transport direction represented by the horizontal arrow 76, the finishing unit 3 is preferably arranged downline of the last printing unit 2*b,* as is shown, but may be disposed upline of the first printing unit 2*a,* as viewed in the sheet transport direction represented by the arrow 76. The printing machine 1 may also include two or more finishing units 3. The finishing unit 3 is of modular construction, it being possible for different units 50 to be installed or inserted selectively into the 53 of the finishing unit 3. For example, the units 50 may be used for coating, i.e., varnishing, for example, or for processing, for example embossing, the printing material or stock, and may also be printing, in FIG. 1 are two units 50 constructed as coating units for varnishing the printing material, each of the coating units 50 having an applicator cylinder 7 for applying a coating liquid to the printing-material sheet lying on an impression cylinder 4. The unit 50 located in the operating position 62 (note FIG. 2) has a feeding device 8, 9, 51 for feeding a highly viscous coating liquid to the cylinder 7. The feeding device, i.e., composed of a metering roller 8, a dip roller 9 and a trough or pan 51 wherein the coating liquid is stored and into which a pan or dip roller 9 which scoops up the coating liquid dips, the dip roller 9 having a metering roller 8 assigned thereto for transferring the coating liquid to the applicator cylinder 7. This unit 50 can be replaced by another unit 50, that is illustrated in an elevated maintenance position 54 at the top of FIG. 1, the other unit 50 in the position 54 having a carrier 6 wherein, in addition to the cylinder 7, at least one further cylinder 8 is also rotatably mounted. Also in this unit 50 at the position 54, the further cylinder 8 mounted in the carrier 6 is in circumferential contact with the cylinder 7. In the case of the last-mentioned unit 50 in the position 54, a feeding system is suitable for feeding a low-viscosity coating liquid, and includes the roller 8 in the form of an anilox or screen roller and a chambered doctor blade 52 assigned to the latter. Depending upon the condition of the coating liquid, for example, the varnish, the units 50 can be inserted into the finishing unit 3 by the operator of the printing machine 1, and can be used selectively for in-line finishing of the printed products.

Figure 2:
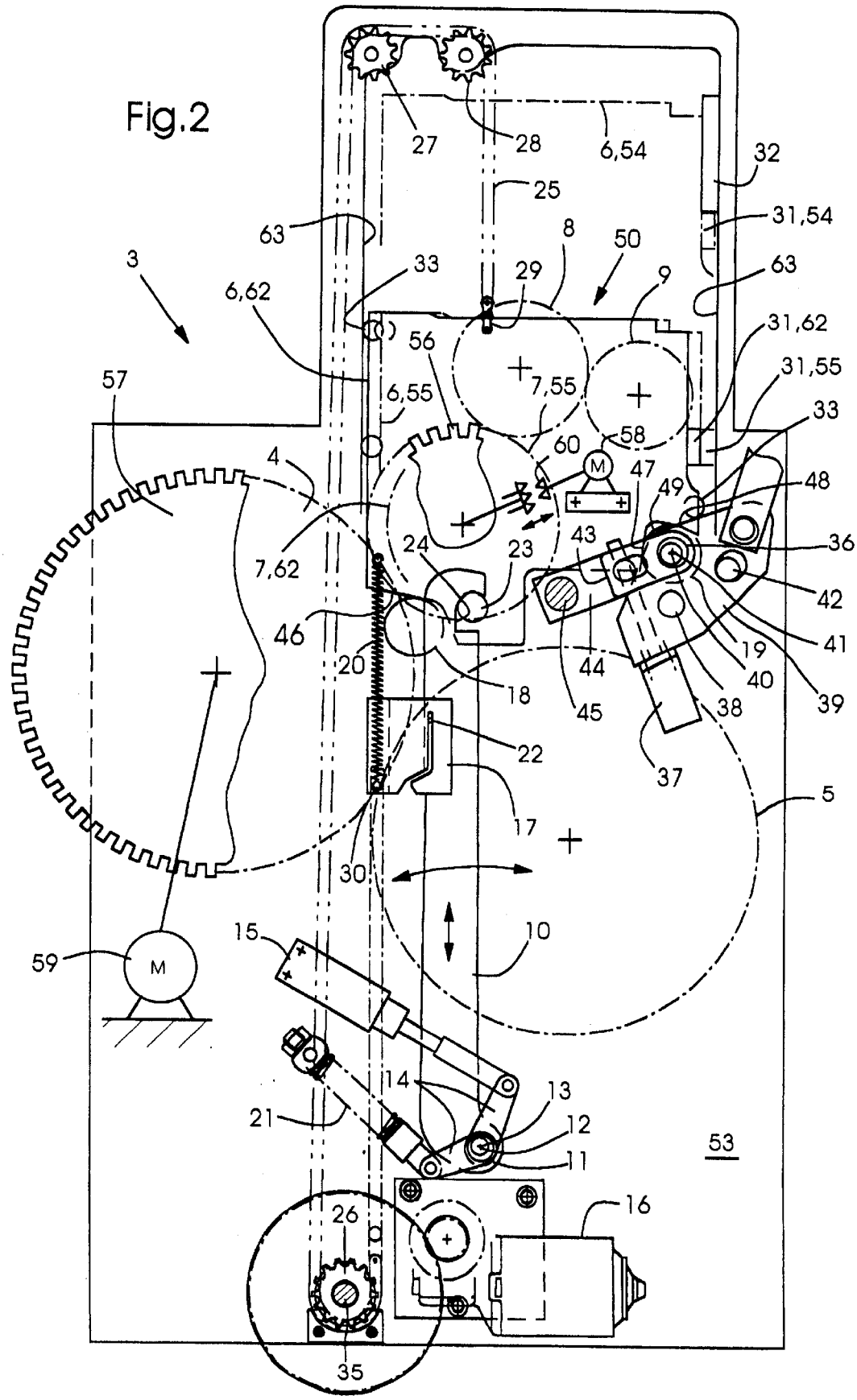
FIG. 2 is an enlarged fragmentary view of FIG. 2 showing the finishing unit with the positioning device according to the invention in greater detail.
Figure 2A:
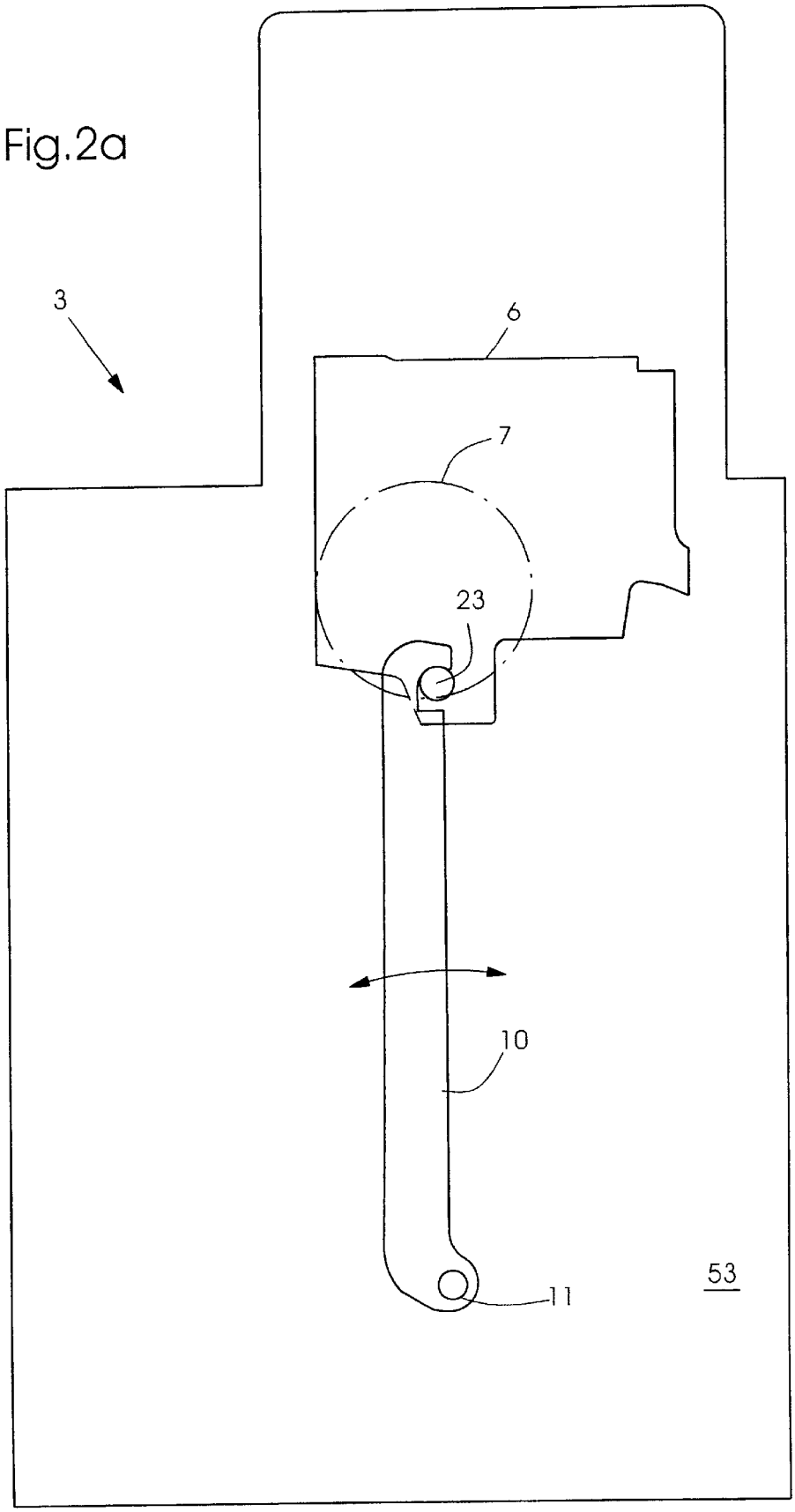

FIGS. 2 and 2*a* illustrate the finishing unit 3 shown in FIG. 1 in detail. The finishing unit 3 includes a positioning device for selectively positioning at least the cylinder 7, which is rotatably mounted in the carrier 6 and, together with the carrier 6, forms a unit 50 that is adjustable into different positions 54, 55 and 62. The unit 50 and the carrier 6, respectively, are adjustable by a mechanism (including a pull mechanism 25, particularly, a chain, and three wheels or sprockets 26, 27, and 28) along a first direction of motion and, in the course thereof, are disposable onto a guide 18, 19. The unit 50 thus seated on the guide 18, 19 is then adjustable along a second direction of motion, guided by the guide 18, 19. The unit 50 is adjustable by the mechanism (25 to 28) from a maintenance and replacement position shown in phantom at 54 in FIG. 2, in a vertical direction to a rest position shown in phantom at 55. In the position 55, the unit 50 is seated on the guide 18, 19, and the cylinder 7 has a minimum spacing from the cylinder 4 carrying the printing material and from the printing material lying on the cylinder 4, respectively. The unit 50, guided by the guide 18, 19 that is formed as an adjustable support or rest, is adjustable from the position 55 into an operating position shown in solid lines at 62, wherein the cylinder 7 cooperates with the cylinder 4 carrying the printing material, and applies the coating liquid to the printing material lying on the cylinder 4. The adjustment of the unit 50 from the position 54 into the position 55 is performed nearly or precisely in the vertical direction and, from the position 55 into the position 62, in a direction that differs from the vertical. The carrier 6 is formed of two side walls, which are arranged offset from one another in the axial direction of the cylinders 7 to 9, between which the cylinders 7 to 9 are arranged and in which the cylinders 7 to 9 are rotatably mounted. The guide 18, 19 includes at least one eccentric 19 that is rotatable about an eccentric bearing 36. Furthermore, the guide 18, 19 includes at least one roller 18, 19. The at least one roller 18, 19 may be the eccentric 19 itself. In the device illustrated in FIG. 2, the eccentric 19 is formed as a roller, and an additional roller 18 is provided whereon the carrier 6 is placed with a guide surface 46 thereof inclined with respect to the horizontal. The eccentric 19 is mounted in a pivoting lever 39 that is pivotable about a pivot bearing 38. By pivoting the pivoting lever 39, the unit 50 can be pivoted out of the position 55 and into the position 62, and back again. By rotating the eccentric 19 about the eccentric bearing 36, the position of the unit 50 relative to the bearing plate 39 formed as a pivoting lever is adjustable, and thus the spacing between the cylinder 7 and the cylinder 4 in the operating position 62 can be adjusted and the spacing is able to be adapted or matched to the thickness of the printing material, respectively. The eccentric bearing 36 is formed of a pin that is mounted in the bearing plate 39, and a bushing that is seated on the pin and is rotatable about the pin axis 40 by the lever 43. The pin and the pin axis 40, respectively, are eccentric relative to the center of the bushing, which corresponds to the axis of rotation 41 of the roller 19 that is rotatably seated on the bushing.

In a modification, the pin and bushing can be connected to one another so that they are fixed against rotation relative to one another, and the pin can be mounted rotatably in the bearing plate 39. Eccentric bearings are common in various constructions and, in addition to those described hereinbefore, other functionally identical constructions may also be used. The pivot axis 12 of the pivot bearing 11 is comparable with the axis 41, the eccentric axis 13 of the pivot bearing is comparable with the axis 40, and the lever 14 for adjusting the pivot bearing 11 is comparable with the lever 43. The function and the purpose of the pivot bearing 11 will be explained hereinafter. The eccentric 19 is rotatable by an actuating drive 37 that is constructed, for example, as an electric motor, the actuating drive 37 rotating the eccentric 19 via the lever 43. The roller 18 is rotatably mounted in a side wall of the frame 53. The guide 18, 19 preferably includes two or more rollers 18 and two or more rollers 19, which are, respectively, arranged so that they align coaxially and are offset relative to one another perpendicularly to the plane of the drawing of FIG. 2, and on which the unit 50 is seated on both sides so that it is secure against tilting. Simultaneous rotation of the two rollers 19 is in this case possible via a synchronizing shaft 45 that drivingly couples the two rollers 19, and is rotated by the actuating drive 37 via the lever 44. The carrier 6 has a surface 47 to 49 having two regions 47 and 48 which support the carrier 6 on the roller 19, and a non-contact region 49 located between the supporting regions 47 and 48, and having a spacing between the surface 47 to 49 and the circumferential surface of the roller 19. Instead of the two straight supporting regions 47 and 48 extending towards one another at an angle, the entire surface 47 to 49 may also be concavely curved. The mechanism is constructed as a pull mechanism drive including a pull mechanism 25, particularly, a chain, and three wheels or sprockets 26, 27, and 28, that adjusts the cylinder 7 and the unit 50, respectively, into the positions 54 and 55 and includes a pull mechanism 25, the unit 50 being held on the pull mechanism 25, suspended from the latter. The pull mechanism drive (25 to 28) is constructed as a formpaired paired-form pull mechanism drive, the pull mechanism 25 of which is guided by at least two and, for example, three wheels 26 to 28 having a form or shape paired with or matching, i.e., complementary to, that of the pull mechanism 25. The pull mechanism drive (25 to 28) is specifically constructed as a chain transmission or drive having a link chain serving as the pull mechanism 25, the wheels 26 to 28 being sprockets engaging in the chain 25, and via which the chain 25 runs. An end 29 is loaded or stressed when the unit 50 is lifted, the chain end 29 being led from above to the unit 50 and fastened to the carrier 6 without springs, while an end 30 of the chain that is without loading or stress during the lifting operation and is led up from below is connected to the carrier 6 and suspended from the latter, respectively, by a spring 20. The pull mechanism drive (25 to 28) is driven by the actuating drive 16, which may be an electric motor, for example, via the drive wheel 26, so that the carrier 6, together with the cylinder 7, can be lifted and lowered selectively into the positions 54 and 55 in a linear and approximately vertical direction of motion by the pull mechanism drive (25 to 28). Like the guide 18, 19, the pull mechanism drive (25 to 28) is also provided in duplicate, a further such pull mechanism drive (25 to 28) for lifting and lowering the unit 50 being arranged offset at right angles to the plane of FIG. 2 and being substantially identical with the illustrated chain drive. The end of the further pull mechanism drive following on and being relieved of the loading when the unit is lifted can, however, be suspended on the unit 50 without a spring. The non-illustrated further pull mechanism drive likewise includes a drive wheel that, like the drive wheel 26, is fastened to the synchronizing shaft 35, so that the two pull mechanism drives are coupled and, operating in parallel, can be driven jointly by the actuating drive 16. The carrier 6 can be locked to the frame 53 by the pivoting lever 10, the locked pivoting lever 10 being pivotable about the pivot bearing 11 while the locking action is being maintained. The pivoting lever 10 is particularly shown in FIG. 2*a*. The pivoting lever 10 and the carrier 6 are couplable with one another by a releasable formlocking connection 23, 24, the pivoting lever 10 being hooked to the carrier 6 and to a part fastened to the latter, respectively. In this regard, it is again noted that a formlocking connection is one that connects two elements together due to the shape of the elements themselves, as opposed to a forcelocking connection that locks the elements together by force external to the elements. Instead of the hook-like construction of the pivoting lever 10, in a possible reversal of the arrangement, the carrier 6 may also have a hook to catch the pivoting lever 10 and a part fastened to the latter, respectively. The illustrated formlocking connection 23, 24 includes the bolt 23 that is fastened to the carrier 6 and about which, during the coupling action, the claw 24 formed on the pivoting lever 10 partially engages. The pivot bearing 11 is adjustable so that, during the adjustment, a pivot axis 12 of the pivot bearing 11 is displaced. For example, the pivot bearing 11 is constructed as an eccentric bearing comparable with the eccentric bearing 36 for displacing the roller 19. The pivot bearing 11 is adjustable via the double lever 14, counter to the restoring action of the spring 21, by an operating cylinder that is used as the actuating drive 15 and that can be acted upon, for example, pneumatically, by a pressurized fluid. The pivoting lever 10 is pivotable by a cam drive or mechanism 17, 22 made up of a connecting link guide 17 and a part 22 guided in the latter. The cam mechanism 17, 22 is constructed so as to drive a pivoting movement of the pivoting lever 10 about the pivot bearing 11 for coupling and hooking, respectively, the pivoting lever 10 to the carrier 6. The connecting link guide 17, formed as a slotted plate, is fastened to the pull mechanism 25 at the end 30 of the chain, and the part 22 guided in the connecting link guide 17 is formed as a pin fastened to the pivoting lever 10. The course of the guide track or slot formed in the connecting link guide 17 is angled off and, at least in sections, is not parallel to the first direction of motion of the unit 50 along the adjustment path between the positions 54 and 55. The locking device 10 to 20, 22 to 24 may be provided in duplicate on both sides of the unit 50, like the guide 18, 19.

The aforedescribed individual functions of the finishing unit 3 are described hereinafter in context once more,by way of example. The operator of the printing machine 1 inserts the unit 50 into the finishing unit 3 in the readily accessible position 54 and attaches the unit 50 to the ends 29 and 30 of the chain. The actuating drive 16 is then activated, so that the unit 50 is lowered from the position 54 until the unit 50 is seated with the surface 46 to 48 on the rollers 18 and 19. During the lowering operation, the unit 50 hangs virtually freely on the pull mechanism 25 and is able to swing to the righthand and lefthand sides in the drawing plane of the figure, to a minimal extent. If the chain acts so that it is offset in the horizontal direction from the mass center of gravity of the unit 50, and the unit 50 is tilted slightly in the plane of the drawn figure, the rollers 33 rest on the walls 63 and, in another embodiment with a chain acting at the center of gravity and the unit 50 hanging undisturbedly on the chain, the rollers 33 may be spaced slightly from the walls 63. During the operation of lowering the unit 50, the slot or groove formed in the coulisse or connecting link guide 17 is pushed over the pin 22, which is then pushed into the downwardly open, wedgeshaped end of the slot or groove formed in the coulisse or connecting link guide 17. During further movement of the connecting link guide 17, which is pulled by the pull mechanism 25, the pivoting lever 10 is adjusted from a non-illustrated pivoting lever position wherein the claw 24 does not yet enclose the pin 23 (unlocked condition) into the pivoting lever position illustrated in FIG. 2, wherein the claw 24 and the pin 23 have a formlocking connection with one another (locked condition). After the unit 50 has been placed onto the guide 18, 19, the pull mechanism 25 tightens or causes a tensioning of the spring 20, the tensioning travel of which is utilized to pivot the pivoting lever 10 into the locking position thereof. This inward pivoting movement is completed when the hook-like end of the pivoting lever 10 encloses the pin 23, and the pin 22 has reached the latching position thereof illustrated in FIG. 2. The coulisse or connecting link guide 17 fastened to the chain 25 is suspended in a sprung manner to the unit 50, just like the end 30 of the chain, so that during the tensioning of the spring 20, the connecting link guide 17 is pulled away somewhat from the unit 50 in the tensioning direction a distance corresponding to the spring travel. The previously occurring locking of the pivoting lever 10 to the carrier 6, and the placing of the unit 50 securely on the guide 18, 19 are then effected by the actuating or adjusting drive 15, the latter being deactivated and, for example, when the actuating drive 15 is formed as a pneumatic cylinder, being vented, so that the spring 21 reverses the eccentric adjustment of the pivot bearing 11. As a result of the adjustment of the pivot bearing 11, the pivoting lever 10 is pulled to a minimum extent in the direction of the pivot bearing 11, or downwardly, so that the locking is secured, by the uppermost inner surface of the claw 24 being pressed firmly onto the circumferential surface of the pin 23, as shown in FIG. 2. The locking can be secured in a forcelocking or formlocking manner by pressing the inner surface onto the pin 23. Forcelocking protection is provided when the top inner surface has a rectilinear contour, so that when the pivoting lever 10 is pivoted to the lefthand side, as viewed in FIG. 2, the area pressure and friction, respectively, acting between the pin 23 and the inner surface pressed onto the latter prevents the claw 24 from slipping off the pin 23, and has the effect of causing the pin 23 and, therefore, the unit 50 to remain coupled to the pivoted pivoting lever 10. Formlocking protection is provided when the top inner surface is formed as a recess that is open at the bottom and that, when the pivoting lever 10 is adjusted downwardly, engages about the pin 23 on both sides from above. For example, the inner surface can have a concave rounding matching the diameter of the pin, the concave rounding being disposed around that half of the pin circumference which is directed upwardly, so that the pin 23 is secured against slipping out of the claw 24 during any pivoting of the pivoting lever 10 both to the lefthand and to the righthand sides as viewed in FIG. 2. As a result of the high transmission ratio of the eccentric bearing 11, the spring 21, formed as a compression spring acting upon a spring rod, is able to apply a high tensioning force for fixing the unit 50 held by the pivoting lever 10 on the guide 18, 19. When the unit 50 is securely fixed, the actuating drive 16 can be deactivated. By pivoting the bearing plate 39 about the pivot bearing 38 thereof, the unit 50 seated on the guide 18, 19 is adjusted along the second direction of motion, guided by the guide 18, 19, towards the impression cylinder 4, from the position 55 (rest position) into the position 62 (operating position). This adjustment is also referred to hereinafter as pressure switching, following the usage of terms that is common for printing units. The spacing between the circumferential surface of the applicator cylinder 7 located in the position 62 and the circumferential surface of the impression cylinder 4, and the pressure of the applicator cylinder 7 against the printing-material sheet to be coated that is lying on the impression cylinder 4, respectively, is possible due to rotation of the eccentric bearing 36, the center of the roller 19, and thus the unit 50 supported on the roller 19, being displaced. This very fine adjustment performed by the actuating or adjustment drive 37 that is formed as an electric stepping motor is also referred to hereinbelow as pressure adjustment. Both during pressure switching and during pressure adjustment, the unit 50 is displaced by an adjustable part of the guide 18, 19, namely the roller 19, and, in this regard, is displaced nearly tangentially along an ideal circular path that the hook-like end of the pivoting lever 10 describes about the pivot bearing 11 during the pivoting operation. An insignificant relative movement of the unit 50 during pressure switching and pressure adjustment, radially relative to the pivot bearing 11, is reliably compensated for by the readjusting action of the spring 21. Due to the great length of the pivoting lever 10 and the great spacing between the locking point and the pivot bearing 11, respectively, during the displacement of the unit 50 on the guide 18, 19, the spring 21 is further subjected to tension and relieved, respectively, only to an insignificant extent, depending upon the respective direction of displacement. The drive or drives effecting the pressure switching and the pressure adjustment, for example, the actuating drive 37, only have to overcome, in addition to the actuating or adjusting forces, the rolling friction in the bearing surfaces of the guide 18, 19, resulting from the pretensioning. The actions of unlocking and removing the unit 50 are performed in the opposite manner, virtually in reverse sequence. For the purpose of unlocking, air is applied to the pneumatic cylinder 15 and the locking device 23, 24 is rendered ineffective via the eccentric bearing 11. The motor 16 then drives the chain 25 and relieves the tension on the spring 20 from which the coulisse or connecting link guide 17 is suspended. The pivoting lever 10 is thereby pivoted away from the illustrated position thereof to the lefthand side of the figure, as viewed in the plane thereof, so that the pin 23 becomes free. The motor 16 which, in this regard, drives the chain 25 in the opposite direction, has the effect of lifting the unit 50 off the guide 18, 19 and adjusting it back along the first direction of motion into the readily accessible maintenance position 54, wherein the stop 31 of the unit 50 lies on the stop 32 of the frame 53, and from which the operator can remove the unit 50 from the finishing unit 3. Instead of the pneumatic cylinder 15, in a further development of or improvement in the device, the movement of the chain can also be used to open the locking device.

If the cylinder 7 cooperates with the cylinder 4 carrying the printing material and, for example, applies a coating liquid to a printing-material sheet lying on the cylinder 4, the cylinder 7 is driven by the drive 59 via the gearwheels 56, 57 by the mechanical coupling, so as to match the cylinder 4. The drive 58 serves to adjust the angle of the cylinder 7 and drives the cylinder 7 during maintenance work, for example, 15 during the cleaning of the latter and any changing of the cylinder cover, the unit 50 and hence the cylinder 7 being located in the readily accessible maintenance position 54.

Figure 3:
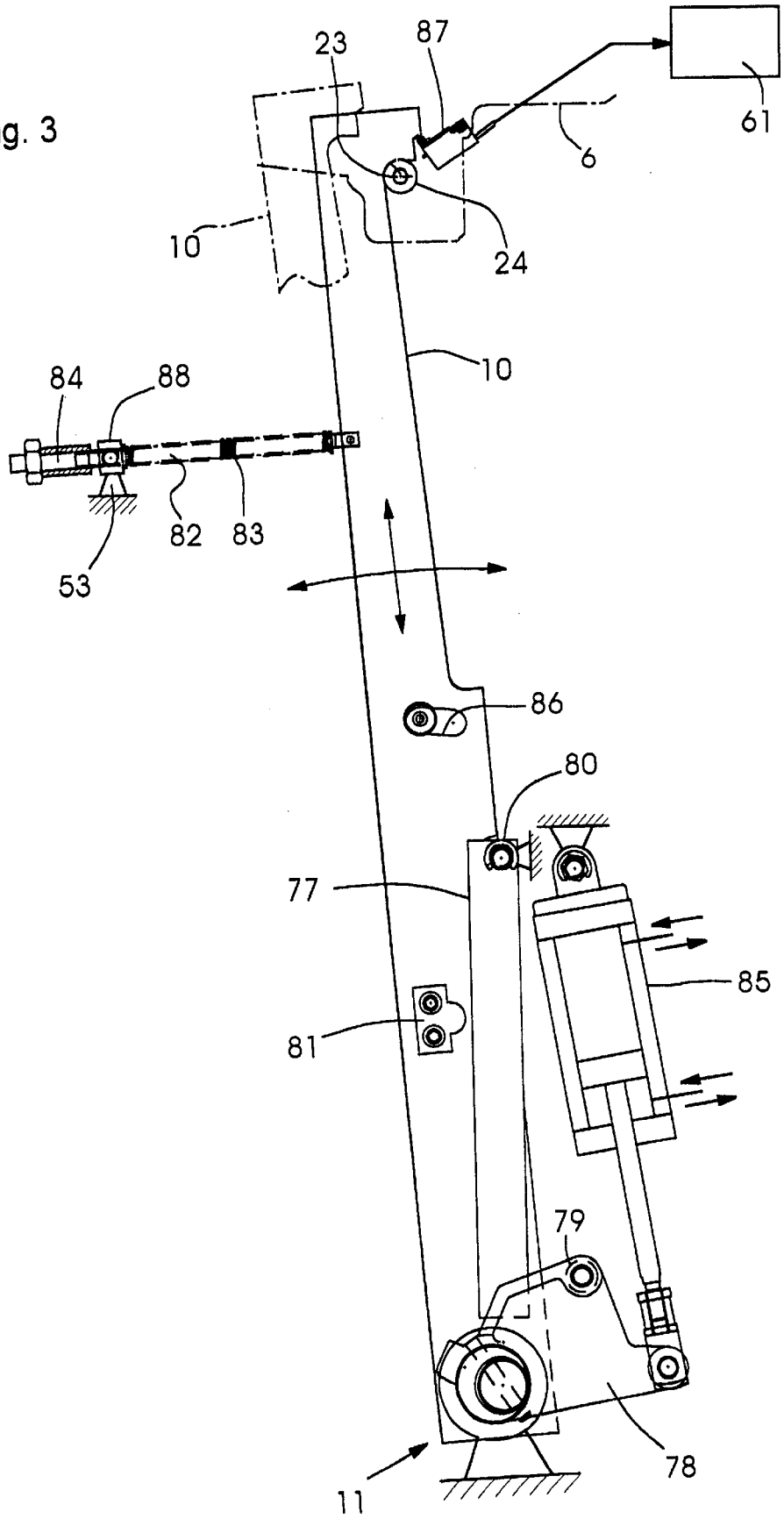
FIG. 3 is an enlarged fragmentary view of FIG. 2 showing another embodiment of a lever transmission for pivoting a pivoting lever of the positioning device.

FIG. 3 shows the essential parts of a modified embodiment of the device illustrated in FIG. 2. Instead of the cam mechanism or drive for pivoting the pivoting lever 10 shown in FIG. 2, in the modified embodiment according to FIG. 3, the pivoting lever 10 is pivoted by a lever drive or mechanism. Besides the parts which are omitted in the modified embodiment and are identified by the reference numerals 14, 15, 17, 21 and 22 (FIG. 2), the device shown in FIG. 3 has all the parts shown in FIG. 2 in the same arrangement, even if those parts have not been illustrated completely in FIG. 3 for reasons of improved clarity. Those parts shown in FIG. 2 which are also again illustrated in FIG. 3, are identified by the same reference.

The pivoting of the pivoting lever 10 in the counterclockwise direction, as shown in FIG. 3, is performed counter to the action of a helical spring 83 supported on the frame and seated on a rod 82 articulatedly connected to the pivoting lever 10. The pivoting movement in the counterclockwise direction which unlocks the pivoting lever 10 from the carrier 6 is driven by the actuating drive 85 and is performed via a lever 78 that adjusts the eccentric bearing 11 and that, simultaneously, presses against a lever 77 which is pivotable about the hinge 80 fixed to the frame and which, in turn, presses against a stop 81 fastened to the pivoting lever 10. The actuating drive 85 is formed as an operating cylinder to which compressed air is applicable and which, when the piston rod is retracted, initially has the effect of adjusting the eccentric bearing 11, so that the pivoting lever 10 is displaced slightly upwardly in the longitudinal direction thereof and, subsequently, via the parts 78, 79 and 81, pivots the pivoting lever 10 counter to the action of a spring 83 about the bearing 11, so that the pivoting lever 10 and the carrier 6 are unhooked from one another. The lever 77 is formed as a single-armed lever which, at one end thereof, is mounted in the hinge 80 so as to hang down loosely and, on the other end thereof forming a long lever arm, presses the roller 79 fastened to the lever 78, so that a region of the lever 77, which results in a short lever arm of the lever 77 and is located between the two ends of the lever 77, strikes against the stop 81 and adjusts the pivoting lever 10 via this stop 81 that is fastened to the pivoting lever 10. The spring 83 formed as a helical spring and wound around the rod 82 can be loaded in compression. The rod 82 is mounted in the frame 53 via a rotating and sliding joint 88, and is connected articulatedly to the pivoting lever 10. The pivoting lever 10 uncoupled from the carrier 6 is illustrated in phantom fragmentarily in FIG. 3. The locking of the pivoting lever 10 and the carrier 6 is performed in the opposite manner. When the application of compressed air to the double-action operating cylinder 85 is changed over or switched, the spring force of the spring 83, that is supported on the frame, acts via the rod 82, which is both pivotably and displaceably mounted in the frame 53, upon the pivoting lever 10, so that the latter is pivoted in clockwise direction and strikes the pin 23 fastened to the carrier 6. The movement of the pivoting lever 10 in the clockwise direction is damped by the damper or dashpot 84, so that the impact of the pivoting lever 10 on the pin 23 takes place very gently. The damper 84 is formed as a piston damper, the piston rod of which is formed by the rod 82 or is coupled to the latter. An adjustment of the eccentric bearing 11 that pulls the pivoting lever 10 downwardly in the longitudinal direction thereof causes the inner surface of the claw 24 to be pressed against or onto the top of the pin 23, this being effected by applying compressed air to the operating cylinder 85 in the direction opposite to that for unlocking, thereby extending the piston rod of the operating cylinder 85. A sensor 87 is used to signal the present coupling state of the pivoting lever 10 and the carrier 6 to the electronic control device 61 of the printing machine 1. The drive 59 (FIG. 2) is deactivated by the control device 61, for example, when the control device 61 interrupts a circuit that supplies the drive 59, if the pivoting lever 10 and the carrier 6 are not correctly coupled when the unit 50 is moved downwardly. The sensor 87 is fastened to the carrier 6 and is formed as an electrical microswitch which can be operated by the pivoting lever 10 and senses the correct locking of the latter to the carrier 6. A guide 86 is formed as a headed screw which is screwed into the frame 53 and is guided in a slot formed in the pivoting lever 10, and which secures the pivoting lever 10 against tilting at right angles to the drawing plane of FIG. 3.

We claim:

1. A printing press, comprising:

a frame;

a carrier adjustably disposed in said frame;

a first cylinder rotatably disposed in said carrier;

a second cylinder in temporary cooperation with said first cylinder, said carrier being adjustable relative to said second cylinder;

a pivoting lever for locking/unlocking said carrier to/from said frame; and a pivot bearing about which said pivoting lever is pivotable;

said pivoting lever being adjustable from a unlocking lever-position, in which said carrier is unlocked from said frame, to a locking lever-position, in which said carrier is locked to said frame via said pivoting lever;

said pivoting lever locking said carrier to said frame and simultaneously being pivotable about said pivot bearing when said pivoting lever is adjusted in said locking lever-position.

2. The printing press according to claim 1, including a releasable formlocking connection, said pivoting lever and said carrier are couplable to one another by said releasable formlocking connection.

3. The printing press according to claim 1, wherein said pivot bearing is adjustable so as to displace a pivot axis of said pivot bearing during the adjustment.

4. The printing press according to claim 1, wherein said pivot bearing is an eccentric bearing.

5. The printing press according to claim 1, including a mechanism selected from the group thereof consisting of a cam mechanism and a lever mechanism, said pivoting lever being pivotable by said mechanism.

6. The printing press according to claim 5, wherein said cam mechanism includes a connecting link guide and a part guidable therein.

7. The printing press according to claim 5, wherein said cam mechanism is constructed for driving said pivoting lever in a pivoting movement about said pivot bearing, said pivoting movement coupling said pivoting lever to said carrier.

8. The printing press according to claim 5, including a spring by which said pivoting lever is pivotable in a first pivoting direction for coupling said pivoting lever and said carrier in a formlocking connection, and in a second pivoting direction, by said mechanism, counter to the action of said spring, for releasing said formlocking connection.

9. The printing press according to claim 8, including a drive for selectively adjusting said carrier into a first position and into a second position, respectively, along an adjustment path.

10. The printing press according to claim 9, wherein said drive is a pull mechanism drive.

11. The printing press according to claim 1, including at least one further cylinder rotatably disposed in said carrier.

12. The printing press according to claim 9, wherein said carrier and said first cylinder together are selectively liftable and lowerable, respectively, by said drive, in a linear and approximately vertical direction of motion, into said first position and into said second position.

13. The printing press according to claim 1, wherein said second cylinder is an impression cylinder.

14. The printing press according to claim 1, wherein said first cylinder is an applicator cylinder.

15. A printing press, comprising:

a frame;

a carrier;

a first cylinder;

a second cylinder;

a pivoting lever;

a pivot bearing;

said carrier being adjustably mounted, so that said carrier is adjustable relative to said second cylinder;

said first cylinder being rotatably mounted in said carrier; and said pivoting lever being adjustable mounted, so that said pivoting lever is adjustable from an unlocking lever-position to a locking lever-position, and that said carrier is unlocked from said frame, when said pivoting lever is adjusted in its unlocking lever-position, and that said carrier is locked to said frame via said pivoting lever and simultaneously said pivoting lever being pivotable about said pivot bearing, when said pivoting lever is adjusted in its locking lever-position.

16. The printing press according to claim 15, wherein said second cylinder is an impression cylinder.

17. The printing press according to claim 15, wherein said first cylinder is an applicator cylinder.

* * * * *